US005152883A

United States Patent [19]

Melin et al.

[11] Patent Number: 5,152,883

[45] Date of Patent: Oct. 6, 1992

[54] PROCESS FOR THE PRODUCTION OF IMPROVED OCTANE NUMBERS GASOLINES

[75] Inventors: Michel Melin, Seneffe; Jacques F. Grootjans, Leefdaal, both of Belgium

[73] Assignee: Fina Research S.A., Belgium

[21] Appl. No.: 623,970

[22] PCT Filed: Jun. 8, 1990

[86] PCT No.: PCT/BE90/00028

§ 371 Date: Mar. 22, 1991

§ 102(e) Date: Mar. 22, 1991

[87] PCT Pub. No.: WO90/15121

PCT Pub. Date: Dec. 12, 1990

[51] Int. Cl.[5] ..... C10G 69/04; C10G 51/02; C10G 55/06; C10G 65/12

[52] U.S. Cl. ..... 208/61; 208/67; 208/68; 208/69; 208/74; 208/75; 208/100

[58] Field of Search ..... 208/67, 68, 69, 100, 208/74, 75

[56] References Cited

U.S. PATENT DOCUMENTS

| | | | |
|---|---|---|---|
| 2,243,298 | 5/1941 | Thomas | 208/74 |
| 3,755,141 | 8/1973 | Youngblood et al. | 208/67 |
| 4,943,366 | 7/1990 | Fischer et al. | 208/68 |

*Primary Examiner*—Theodore Morris
*Assistant Examiner*—P. L. Hailey
*Attorney, Agent, or Firm*—Jim D. Wheelington

[57] ABSTRACT

Process for producing gasolines having improved RON and MON which consists in subjecting the LCO, HCO and CLO obtained by catalytic cracking of a heavy hydrocarbon feedstock, to a hydrogenation treatment and subjecting the obtained products to a new catalytic cracking and then recovering hydrocarbons boiling in the range of gasolines.

6 Claims, 1 Drawing Sheet

PROCESS FOR THE PRODUCTION OF IMPROVED OCTANE NUMBERS GASOLINES

Figure 1:
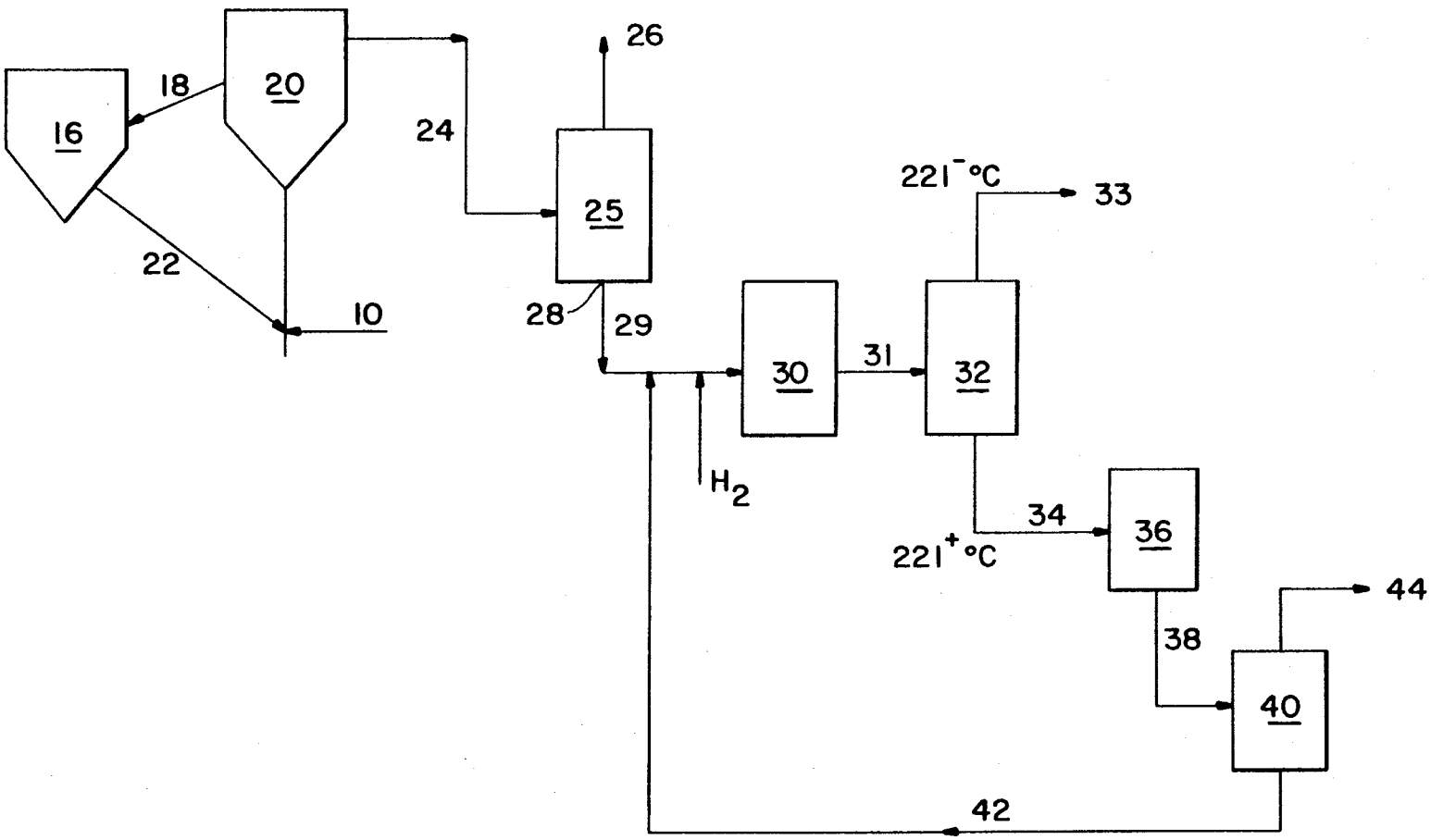

The present invention relates to a process for the production of high octane number gasolines. More specifically, the present invention relates to the production of improved RON and MON gasoline from heavier hydrocarbon feedstocks which come from fluidized bed catalytic cracking of vacuum gasoils, deasphalted oils and residues.

The fluidized bed catalytic cracking process of heavy hydrocarbon feedstocks such as vacuum gasoils is a well known process in particular for producing gasolines. Moreover. because of the removal of lead additives, it is very important to produce high octane number gasolines. Therefore. there is a need for producing from the same feedstocks gasolines with improved octane numbers or RON ("Research" octane number) and specifically MON ("Motor" octane number).

It is well known to subject heavy hydrocarbon feedstocks such as gasoils. vacuum gasoils or other analogues, to a fluidized bed catalytic cracking (FCC) in order to produce light products rich in olefins and hydrocarbons boiling in the range of gasolines. Heavier products are also produced such as light cycle oils (LCO) boiling between 221 and 350° C., heavy cycle oils (HCO) boiling between 350 and 400° C. and clarified oils (CLO) boiling at a temperature higher than 400° C. More often, HCO and CLO are used as fuel components, while LCO is subjected to a hydrogenation treatment to improve its characteristics in order to be used as diesel component for example.

It is also described that there is an advantage to subject only the hydrogenated LCO to a FCC treatment with a partially desactivated FCC catalyst but it requires complicated making of the catalytic cracker which has to be used.

The Applicant has now found that there was a possibility to improve significantly the RON and MON of the gasolines produced by catalytic cracking of heavy hydrocarbons.

The present invention relates to a process for producing gasolines with improved RON and MON from heavy hydrocarbon feedstocks.

The present invention also relates to a process for producing gasolines with improved RON and MON from hydrogenated LCO. HCO and CLO.

The process according to the present invention for producing gasolines with improved RON and MON is characterized by the following steps :

a. A heavy hydrocarbon feedstock is subjected to a fluidized bed catalytic cracking by contacting it with a fluid catalyst of catalytic cracking in order to produce gaseous products, hydrocarbons boiling in the range of gasolines, LCO. HCO and CLO;
b. The catalyst is separated from the generated products;
c. LCO, HCO and CLO are separated and sent into another reactor where they are subjected to a hydrogenation step at a temperature comprised between 320 and 420° C., at a pressure comprised between 30 and 200 bars and in the presence of a hydrogenation catalyst in order to produce gaseous hydrocarbons, hydrocarbons boiling in the range of gasolines and hydrocarbons boiling at a temperature higher than about 221° C.;

d. Hydrocarbons from step (c) boiling at a temperature higher than about 221° C. are separated;
e. Hydrocarbons from step (d) boiling at a temperature higher than about 221° C. are subjected to a fluidized bed catalytic cracking in a reactor which is preferentially different from step (a).
f. Hydrocarbons from step (e) boiling in the range of gasolines with improved RON and MON are recovered.

The present invention is also described in an annexed drawing in which FIG. 1 represents a schematic diagram according to the process of the invention.

Referring to FIG. 1. a heavy hydrocarbon feedstock which can be gasoil, vacuum gasoil or the same, is introduced through pipe 10. This feedstock is introduced into the FCC reactor 20 in which it is contacted with a fluid catalyst of catalytic cracking coming from pipe 22. The feedstock and the catalyst are mixed together and carried upwards. The catalyst is made of fine particles so that it acts as a fluidized bed. The reaction occurs into reactor 20; the catalyst comes down by gravity and is recovered for regeneration through pipe 18 into reactor 16 while several products of catalytic cracking which comprise gaseous hydrocarbons, hydrocarbons boiling in the range of gasolines, LCO. HCO and CLO are recovered through pipe 24 and sent into a separator (25) in which gaseous and light products coming from pipe 26 are separated from heavier products coming from pipe 28. The light products which are recovered through pipe 26 are made of hydrocarbons boiling in the range of gasolines.

Heavy products coming from pipe 28 are composed of LCO boiling between 221 and 350° C., HCO boiling between 350 and 400° C. and CLO boiling at a temperature higher than 400° C.

According to an embodiment of the process of the invention, LCO, HCO and CLO are successively separated and then subjected separately to a hydrogenation treatment. According to another embodiment of the process of the invention, LCO, HCO and CLO are subjected together to a hydrogenation treatment. Whichever embodiment is chosen, the feedstock going out through pipe 28 is mixed with hydrogen coming from either source as hereinafter defined. Then the mixture feedstock hydrogen is introduced through pipe 29 into the dehydrogenation zone 30 in presence of a hydrogenation catalyst at a temperature comprised between 320 and 420° C. and under a pressure comprised between 30 and 200 bars.

Usually, the hydrogenation catalyst is a fixed bed in reaction zone 30. The feedstock to be hydrogenated goes through the catalytic bed which is maintained under hydrogenation conditions as hereabove mentioned. The effluent product is withdrawn from reactor 30 through pipe 31 and introduced into separator 32 where gaseous products and products boiling in the range of gasolines (i.e. at a temperature lower than 221° C.) are separated through pipe 33 from hydrogenated products boiling at a temperature higher than 221° C. through pipe 34. These hydrocarbons boiling at a temperature higher than 221° C. are subjected to another fluidized bed catalytic cracking in reactor (36) which is preferentially different from reactor (20). The treated hydrocarbons are recovered through pipe (38) and separated into separator (40) between products boiling in the range of gasolines and heavier products (LCO, HCO and CLO) which are recycled in the hydrogenation reactor 30 through pipe (42) while gasolines with improved RON and MON are recuperated through pipe (44).

The Applicant has unexpectedly found that when all hydrogenated products having a boiling point higher than 221° C., taken together or separately, are subjected to a FCC. the total amount of gasolines obtained by the process of the invention is increased and the RON and MON are greatly improved.

According to the process of the invention other embodiments of fluidized bed catalytic cracking can be adapted. The main thing is to subject again to a FCC the hydrogenated hydrocarbons boiling at a temperature higher than 221° C.

The Applicant has thus found that subjecting hydrogenated LCO. HCO and/or CLO to a new FCC leads to gasolines with improved RON and MON. In the state of the art, it is taught that it is essential to limit the FCC reaction of LCO, HCO and/or CLO to partially desactivated catalysts in order to obtain good gasoline yields. On the contrary, an essential feature of the present invention lies in contacting with a fresh FCC catalyst in order to obtain gasolines with improved RON and MON. If a second FCC reactor is not available, the hydrocarbons coming from pipe 34 may be mixed with the VGO (vacuum gasoils) feedstock and recycled into the first FCC reactor (20). However, the RON and MON values of the obtained gasolines are slightly lower then those obtained according to the embodiment of the above-described process.

Hydrogenated LCO. HCO and/or CLO may also be introduced into a second transport reactor ("viser") which is mounted in parallel with the reactor reserved for the normal FCC feedstock (20). According to another embodiment, the FCC (20) may be used for cracking the feedstocks (normal heavies and hydrogenated LCO, HCO and/or CLO) batchwise. The two preceding examples are only to be considered as practical realization examples. Indeed, the essential feature is to contact the hydrogenated LCO, HCO and/or CLO feedstocks with a fully active catalyst.

It is of course not necessary to treat the hydrocarbons having a lower boiling temperature considering that they are recovered as gasoline either through pipe 33 or through pipe 26.

There are a lot of appropriated catalysts which can be used in catalytic cracking processes, e.g. amorphous silica-alumina, silica-magnesia, crystalline zeolite catalysts such as faujasite or other analogues, such as zeolites Y dispersed in a matrix of silica and another inorganic oxide or in an alumina matrix. The zeolites can also be used pure with or without zeolitic promoters such as ZSM-5 or silicalite.

Usually, matrixes are made of silica-alumina in a ratio 90-40/10.60, in which zeolites are dispersed. Zeolites are generally rare earth exchanged zeolites Y or ultra-stable zeolites (the dealumination mode being variable).

Promoters can also be added at the ratio of 5 to 15% by weight of the used zeolite. The catalytic cracking is usually done at temperatures comprised between 480 and 550° C., preferably between 510 and 530° C., and under pressures comprised between 1 and 4 bars, preferably between 1 and 2 bars.

The hydrotreatment catalyst is preferably sulfur resistant. Most are Group VI and Group VIII metals catalysts deposited on an alumina or a silica-alumina support and other similar supports. Most of the time, a Nickel-Molybdene catalyst deposited on alumina or silica-alumina is used.

Hydrogenation operating conditions are temperatures comprised between 270 and 500° C., pressures comprised between 30 and 200 bars, preferably between 60 and 120 bars, a LHSV comprised between 0.5 and 5 and a ratio $H_2$/HC comprised between 500 and 50,000 NL/L.

The following examples are given in order to better illustrate the present invention but without limiting it.

EXAMPLES 1 TO 3

A feedstock composed of VGO (characteristics thereof given in the following table) is subjected to a catalytic in the following operating conditions:

| | |
|---|---|
| T°: | 520° C. |
| Pressure: | atmospheric |
| Feed: | 600 gr/hour |
| Catalyst/feedstock (wt/wt): | 6 |
| | 100% VGO Base feedstock |
| Density | 0.9240 |
| Sulfur (%) | 1.8375 |
| Aniline point (°C.) | 79.2 |
| Refraction index at 50° C. | 1.5024 |
| Aromatics (UV) (millemoles/100 gr) | |
| MONO | 55 |
| DI | 19 |
| TRI | 18 |
| TETRA | 15 |
| PENTA + | 1 |

At the outlet of the catalytic cracking reactor, products boiling in the range of gasolines are separated from LCO, HCO and CLO. LCO, HCO and CLO are separately subjected to a hydrogenation in presence of a Ni-Mo catalyst and under the conditions indicated in Table 1. At the outlet of the hydrogenation reactor products boiling in the range of gasolines are separated from those having a boiling point higher than 221° C. Products having a boiling point higher than 221° C. are sent directly into a second catalytic cracking reactor under the conditions indicated in Table 1. Properties of the gasolines produced at the outlet of this last catalytic cracking catalyst are indicated in Table 1.

For comparison, a same VGO feedstock was subjected to a FCC in the same conditions as hereabove indicated. Gasolines obtained by this process showed a RON of 91.7 and a MON of 78.6. According to the process of the invention, the MON Is 3 points higher which is very advantageous.

EXAMPLE 4

A feedstock composed of VGO (characteristics given in Table 1) and a recycled stream made of hydrogenated LCO are separately subjected to a catalytic cracking under the following operating conditions:

| | |
|---|---|
| T°: | 520° C. |
| Pressure: | atmospheric |
| Feed: | 600 gr/hour |
| Catalyst/Feedstock (wt/wt): | 6 |

At the outlet of the catalytic cracking reactor, products boiling in the range of gasolines were separated from LCO, HCO and CLO. The HCO were subjected to a hydrogenation at a temperature of 390° C. and under a pressure of 120 bars, at a LHSV of 0.6. At the outlet of the hydrogenation reactor, products boiling in the range of gasolines were separated from those having a boiling point higher than 221° C. and they were directly sent into a second catalytic cracking reactor. Properties of gasolines produced at the outlet of this last catalytic cracking reactor are indicated in Table 1.

TABLE 1

| | Ex 1 | Ex 2 | Ex 3 | Ex Comparative | Ex 4 |
|---|---|---|---|---|---|
| Hydrotreatment feedstock analysis | (LCO) | (HCO) | (CLO) | | |
| Density | 0.909 | 1.000 | 1.033 | | |
| Sulfur (%) | 1.725 | 2.536 | 0.9702 | | |
| Basic nitrogen (ppm) | 16 | 122 | 409 | | |
| Total nitrogen (ppm) | 448 | 1,640 | 1,290 | | |
| Conradson carbon (%) | — | — | — | | |
| Hydrotreatment conditions | | | | | |
| Pressure (bar g) | 60 | 120 | 120 | same as | |
| Temperature (°C.) | 360 | 340 | 360 | example 1 | |
| LHSV ($Hr^{-1}$) | 2 | 0.6 | 0.6 | for | |
| Recycled gas (Nl/1) | 1,000 | 1,000 | 1,000 | LCO | |
| catalyst | Ni—Mo on alumina | Ni—Mo on alumina | Ni—Mo on alumina | | |
| Hydrotreatment material balance | | | | | |
| Fuel gas | 3.19 | 1.80 | 1.18 | | |
| C3 | 0.89 | 0.06 | 0.06 | | |
| I-C4 | 0.14 | 0.56 | 0.01 | | |
| N-C4 | 0.40 | 2.82 | 0.04 | | |
| C5-221° C. | 21.52 | 4.82 | 1.54 | | |
| 221+C. | 75.37 | 92.37 | 100.18 | | |
| Analysis of the 221+C cut produced by hydrotreatment (or of FCC feedstock) | (100% LCO hydrot.) | (100% HCO hydrot.) | (100% CLO hydrot.) | (100% VGO base charge) | (75% VGO 25% LCO hydrot.) |
| Density | 0.880 | 0.9447 | 0.971 | 0.9240 | 0.9122 |
| Sulfur (%) | 0.0336 | 0.2427 | 0.0376 | 1.8375 | 1.4044 |
| Aniline point (°C.) | 44.2 | 43.4 | 55.5 | 79.2 | 70.6 |
| Refraction index at 50° C. | 1.4798 | 1.5120 | — | 1.5024 | 1.4971 |
| Molecular weight | 172 | 261 | 370 | — | — |
| Aromatics (UV) (millemoles/100 gr) | | | | | |
| MONO | 84 | 113 | 90 | 55 | 49 |
| DI | 24 | 13 | 21 | 19 | 21 |
| TRI | 4 | 13 | 16 | 18 | 14 |
| TETRA | 3 | 7 | 26 | 15 | 11 |
| PENTA + | 0 | 0 | 3 | 1 | 1 |
| Catalytic cracking yield (wt %) | | | | | |
| GAS | 19.24 | 18.82 | 13.22 | | |
| MCCS ($C_5$-100° C.) | 19.18 | 17.95 | 14.85 | 21.71 | 20.49 |
| HCCS (100-221° C.) | 23.79 | 24.54 | 20.74 | 25.26 | 23.51 |
| LCO (221-350° C.) | 33.69 | 23.69 | 22.51 | 18.69 | 25.85 |
| HCO/MCB (350+°) | 2.78 | 13.09 | 24.43 | 12.40 | 8.66 |
| COKE | 1.32 | 1.91 | 4.26 | 2.82 | 2.43 |
| CONVERSION (221° C.) | 63.53 | 63.22 | 53.07 | 68.91 | 65.49 |
| Analysis of the produced gasoline (C5-221° C.) | | | | | |
| FIA % vol. | | | | | |
| Arom. | 51 | 54 | 46 | 34 | 34 |
| Ollf. | 9 | 9 | 11 | 38 | 33 |
| Satur. | 40 | 37 | 43 | 28 | 33 |
| RON (GC) | 93.7 | 96.4 | 94.8 | 91.7 | 92.2 |
| MON | 81.6 | 82.7 | 79.4 | 78.6 | 80.3 |

We claim:

1. Process for producing improved Research Octane Number (RON) and Motor Octane Number (MON) gasolines comprising:

(a) subjecting a heavy hydrocarbon feedstock to fluidized bed catalyst cracking by contacting it with a fluid catalyst of catalytic cracking in order to produce gaseous products, hydrocarbons boiling in the range of gasolines, light cycle oil, heavy cycle oil and clarified oil;

(b) separating the catalyst from the generated products;

(c) separating light cycle oils, heavy cycle oil and clarified oil and sending them into another reactor where they are subjected to a hydrogenation step at a temperature comprised between 320 and 420° C., at a pressure comprised between 30 and 200 bars and in the presence of a hydrogenation catalyst in order to produce gaseous hydrocarbons, hydrocarbons boiling in the range of gasolines and hydrocarbons boiling at a temperature higher than about 221° C.;

(d) separating hydrocarbons from step (c) boiling at a temperature higher than about 221° C.;

(e) subjecting hydrocarbons from step (d) boiling at a temperature higher than about 221° C. to a fluidized bed catalytic cracking with a fresh FCC catalyst in a second FCC reactor which is preferentially different from step (a);

(f) recovering hydrocarbons from step (e) boiling in the range of gasolines with a RON greater than 92 and a MON greater than 79.

2. Process according to claim 1 further comprising subjecting the hydrogenated light cycle oil produced at step (c) to fluidized bed catalytic cracking.

3. Process according to claim 1 further comprising subjecting the hydrogenated heavy cycle oil produced at step (c) to fluidized bed catalytic cracking.

4. Process according to claim 1 further comprising subjecting the mixture hydrogenated clarified oil produced at step (c) to fluidized bed catalytic cracking.

5. Process according to claim 1 further comprising subjecting the mixture light cycle oil, heavy cycle oil, and clarified oil from step (c) to fluidized bed catalytic cracking.

6. Process according to any one of claims 1 to 5 further comprising subjecting the light cycle oil, heavy cycle oil and clarified oil recovered from step (c) together or separately to a hydrogenation treatment at a temperature comprised between 270 and 500° C., under a pressure comprised between 60 and 120 bars, at a LHSV comprised between 0.5 and 5 and with a hydrogen to hydrocarbon ratio comprised between 500 and 50,000 liter of gas (normal conditions) per liter of liquid.

* * * * *